US005088118A

United States Patent [19]

Whiteley

[11] Patent Number: 5,088,118

[45] Date of Patent: Feb. 18, 1992

[54] ARTICLE AND METHOD FOR TYING NECKTIES

[76] Inventor: F. Howard Whiteley, 1913-A W. Chipman Rd., Lee's Summit, Mo. 64081

[21] Appl. No.: 319,558

[22] Filed: Mar. 6, 1989

[51] Int. Cl.[5] ..... A41D 25/08

[52] U.S. Cl. ..... 2/144; 2/150; 2/137

[58] Field of Search ..... 2/137, 144, 145, 146, 2/148, 150, 152 R, 152 A; 33/2 R

[56] References Cited

U.S. PATENT DOCUMENTS

| | | | |
|---|---|---|---|
| 2,499,260 | 2/1950 | Rhein | 2/146 |
| 2,739,313 | 3/1956 | Burton | 2/146 |
| 2,994,886 | 8/1961 | Sharp | 2/146 |
| 3,025,528 | 3/1962 | Minter | 2/144 |
| 3,271,780 | 9/1966 | De Jean | 2/146 |
| 3,305,933 | 2/1967 | Munday | 33/2 R |
| 3,321,773 | 5/1967 | Orciuch | 2/146 |
| 3,335,426 | 8/1967 | Light | 2/146 |
| 3,490,073 | 1/1970 | Webster | 2/146 |
| 3,571,935 | 3/1971 | Van Wye | 2/146 |
| 3,747,220 | 7/1973 | Weisnicht | 2/146 |
| 3,797,044 | 3/1974 | Chow | 2/146 |
| 3,946,444 | 3/1976 | Parrilla | 2/144 |
| 4,564,958 | 1/1986 | Woodward | 2/150 |
| 4,696,064 | 9/1987 | Morwood | 2/144 |

*Primary Examiner*—Werner H. Schroeder
*Assistant Examiner*—Gloria Hale
*Attorney, Agent, or Firm*—Hovey, Timmons, Williams & Collins

[57] ABSTRACT

An article and method for tying neckties is presented which serves to assist the user in positioning the necktie in precise relationship to a chosen location point on the user's apparel or anatomy. The method hereof includes the steps of affixing a small maker element to the necktie and then positioning the marker adjacent a chosen fixed location point on the wearer's anatomy or apparel, whereby the ends of the tie will then drape in a desired position once the tie is tied in accordance with the wearer's habitual tying method. The article includes a support member presenting a scale along one edge thereof and having marker elements located thereon for use in measuring and marking a tie during tying thereof.

17 Claims, 3 Drawing Sheets

ARTICLE AND METHOD FOR TYING NECKTIES

BACKGROUND OF THE INVENTION

1. Field of the Invention

This invention concerns a method for tying neckties in which a long and narrow strip of fabric may be tied in a manner which will enable the user or wearer to quickly and easily tie the tie so that it drapes precisely in a desired relationship to the wearer's apparel and anatomy. The invention also includes a system or article useful in conjunction with the method for measuring the distance the tie must be moved and affixing a marker element. The system and method hereof are useful in conjunction with placement of the tie between the folded elements of a shirt collar and held in place by a knot centered at the front of the collar.

2. Description of the Prior Art

It is well-known to tie a tie after the fabric strip making up the tie is entered between the folded elements of a shirt collar so that the tie drapes downwardly along the front of the shirt. Thereafter, the wearer may tie the tie in one of several different desired knots, such as the four-in-hand, half-Windsor or Windsor knots. Unfortunately, however, the tie will rarely be in precisely the desired position except by accident.

Much effort has heretofore be asserted in an attempt to provide a device that would simplify and ease the task of correctly tying ties to the user's satisfaction. None of the prior efforts have provided a way to compensate for all the differences in tie materials, shapes and sizes, different styles of knots, the users habit of tying his knots tightly or relatively loosely, differences in the wearer's anatomies, (fat or slim, long or short waisted, neck sizes, etc.) as well as the user's personal preference. Most have been cumbersome and awkward to use. As a result, non have gained wide public acceptance.

SUMMARY OF THE INVENTION

It is thus a primary object of this invention to provide the wearer's of ties with an inexpensive articles and method for use therewith which will enable the wearer to quickly and easily tie his ties so that they draped precisely in the desired relationship to the wearer's apparel and anatomy.

It is a further object of this invention to provide an article and method for tying ties that compensate for all of the variables affecting the accuracy and precision of the positioning process including variations in configuration, weave, weight and flexibility of fabric, type of knot employed by the user (four-in-hand, half-Windsor, Windsor, etc.), how tight the user ties the knot, shirt collar style, shape and size of the wearer's anatomy and the personal preferences of the wearer.

It is a further object of this invention to provide an article and method for strategically placing an unobtrusive, visually and tactily recognizable marker element on a tie in precise relationship to a chosen fixed reference point on the wearer's apparel or anatomy (e.g. collar button or adam's apple), so that when the tie is positioned in the collar in the normal manner, with the marker adjacent to the chosen reference point, the user may proceed to tie the knot in the same manner used in establishing the marker element location and the tie will then drape in the desired relationship to the wearer's apparel and anatomy.

It is a further object of the preferred form of this invention to provide an article and method whereby the tie user can, without use of a mirror or without light to make parts visible, quickly and precisely position and knot his tie so that it drapes in the desired relationship to the wearer's person and apparel, thus, not only making positioning and tying a tie in a precise and easy manner for the physically normal but, once the marker is correctly affixed to the tie, likewise for the visually handicapped.

It is a further object of the preferred form of this invention to provide an article and method that eliminates the need for bulky, inflexible marking elements by using a thin, preferably flexible material for the tie marking element.

In accordance with these objects, the invention hereof broadly includes a method which includes affixing to the necktie a small marker element which is both visually and tactily distinguishable from the material of the necktie, positioning the marker element adjacent a location point on the wearer's apparel or anatomy, and draping the tie around the wearer's collar whereby, upon tying the tie in the wearer's habitual manner, the first and second ends of the tie will be located in a desired position. The invention hereof also includes a thin support member for use in connection with tying a necktie which includes a substrate having a scale imprinted upon one edge and including a plurality of marker elements which are releasably attached to the substrate for attaching to the wearer's necktie.

In the preferred article of the invention, both temporary and permanent markers are provided, each having a pressure sensitive adhesive coating on one side thereof. The temporary markers are provided with an adhesive coating which will permit repeatedly applying and removing a temporary marker during the process of locating the proper position for a final permanent marker. Permanent markers are provided with a pressure sensitive adhesive coating on one side that will cause the marker to adhere permanently or semi-permanently to the tie when pressed against the tie material.

The thin flexible marker used in the preferred form of the invention is small and permits the user to position more than one permanent marker on a tie to facilitate tying different types of knots for different styles of collars. By using the method and system provided by this invention, the tie user may position one marker for use in tying a four-in-hand knot, position a second marker for tying a half-Windsor knot and a third marker for tying a full Windsor knot. Because the markers are normally affixed to the tie in a concealed position on the underside of the tie and are made from a thin flexible material conforming to the shape of the tie, there is no bulk or interference by the markers and they are always available to permit the user to tie the type of knot he wishes for the type of apparel and social occasion of his immediate concern.

Other objects of the invention will be readily apparent from the following detailed discussion of the drawings.

DESCRIPTION OF THE PREFERRED EMBODIMENT

Figure 1:
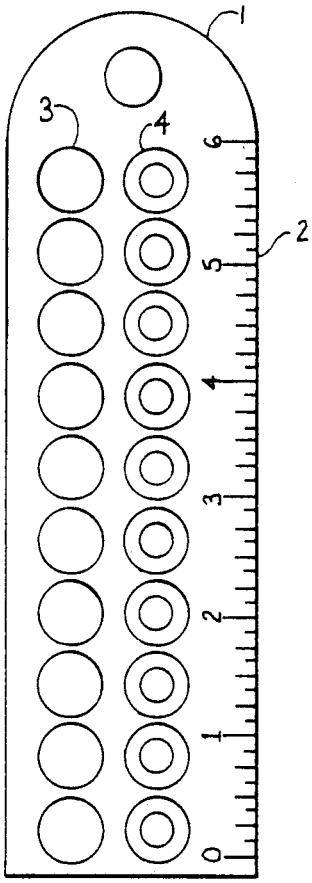
FIG. 1 is a front elevational view of the support member in accordance with the present invention showing a substrate having a scale extending along one edge and carrying temporary marker elements and permanent marker elements arranged in rows thereon.

Referring now to the drawings, a support member 1 includes a thin elongated substrate having at least one edge along which a graduated measuring scale 2 is imprinted thereon. As shown in FIG. 1, the scale includes graduations one through six for purposes as will be described hereinafter. The edge along which the scale is imprinted serves as a supporting substrate for carrying a row of temporary marker elements 3 and a row of permanent or semi-permanent marker elements 4. Each temporary marker element 3 is provided with one side having a pressure sensitive coating thereon so that the temporary marker elements may be removed from the support member and repeatedly applied to and removed from a necktie. The permanent marker elements 4 are provided with a side having a pressure sensitive adhesive coating so that they may be removed from support member 1 and affixed to a tie in a permanent or semi-permanent set. The temporary marker elements 3 and the permanent marker elements 4 are thin, preferably flexible material which are both visually and tactily distinguishable from the material of the tie. The temporary marker elements 3 and the permanent marker elements 4 are sufficiently flexible to conform to the shape of the tie as it flexes.

Figure 2:
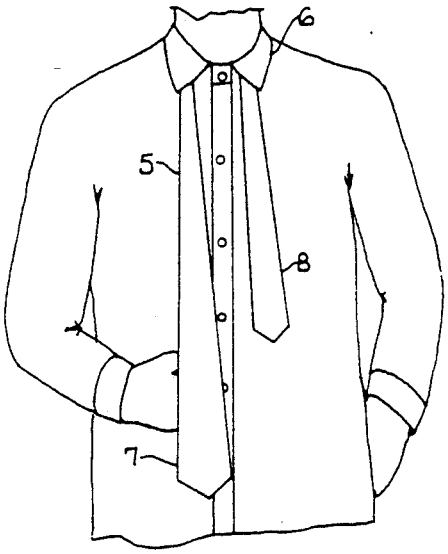
FIG. 2 is a front diagrammatic view of a wearer showing a four-in-hand type necktie entered between the folded elements of a collar of the wearer's shirt with the ends of the tie dangling loosely from the collar prepatory to tying a knot in the tie at the front of the collar.

FIG. 2 illustrates the initial positioning of a tie 5 in an enfolded shirt collar 6 in accordance with the method of the present invention. The tie 5 is positioned with the wide tie end 7 and the narrow tie end 8 extending downwardly prior to tying a knot in the tie 5 in front of the collar 6.

Figure 3:
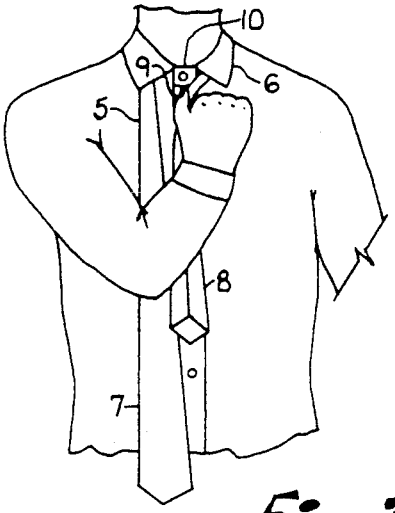
FIG. 3 is a front diagrammatic view similar to FIG. 2, illustrating the wearer grasping a first, narrow end of the tie with his thumb adjacent a chosen location point.
Figure 4:
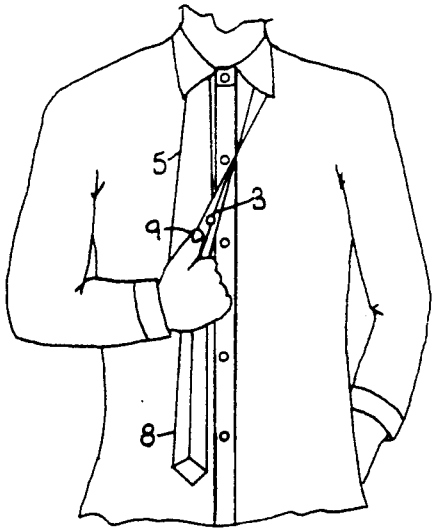
FIG. 4 is a front diagrammatic view similar to FIG. 3, illustrating the wearer's placement of a temporary marker element affixed to the underside of the tie adjacent the end of the wearer's thumb, with the narrow end of the tie down downwardly.
Figure 5:
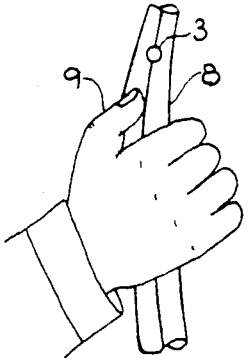
FIG. 5 is an enlarged fragmentary diagrammatic view showing the placement of the temporary marker element on the tie adjacent the end of the wearer's thumb.

Thereafter, the user of wearer grasps the narrow end 8 of the tie 5 so that the end of the wearer's thumb 9, touches a chosen location point, as shown in FIG. 3. The chosen location point may be collar button 10 or some other point on the wearer's apparel or anatomy. The wearer then pulls the narrow end 8 of the tie 5 downwardly a sufficient distance to facilitate placing a temporary marker element 3 on the narrow end 8. As illustrated in FIG. 4, the temporary marker element 3 is removed from support member 1 and placed adjacent the end of the wearer's thumb 9. As illustrated in FIG. 5, temporary marker element 3 is preferably positioned on the back side of the narrow end 8 of the tie 5 along the centerline thereof.

After affixing the temporary marker element 3, the wearer the repositions the tie by sliding the tie 5 in the collar 6 moving the narrow end 8 upwardly until the end of his thumb 9 touches the collar button 10 (the chosen location point) as shown in FIG. 3. So located, the temporary marker element 3 is positioned adjacent collar 6 in the wearer's habitually accustomed manner. By so doing, all of the variables governing the combined length of the wide tie end 7 and the narrow tie end 8 that will drape downwardly from the tie knot, such as the wearer'a neck and collar size, the knot size, how tight the user ties his knots, the weight and weave of the tie material, the shape of the user's anatomy, and other factors have now exerted their influence and will remain constant when a temporary marker element 3 is moved a distance equal to the desired change in the tie end resting point location. Thereafter, when the tie is positioned, held and tied in a like manner with the marker adjacent the chosen location point, the tie ends 7 and 8 will also drape to precisely the desired resting points.

The tie will rarely be properly positioned so that the tie ends 7 and 8 rest in a desired location on the first try, except possible by accident. In such a rare instance, the wearer need only remove a permanent marker element 4 from supporting member 1 and replaces the temporary marker element 3 with a permanent marker element 4, leaving the permanent marker element 4 in the correct location to position the tie for future knot tying.

Figure 6:
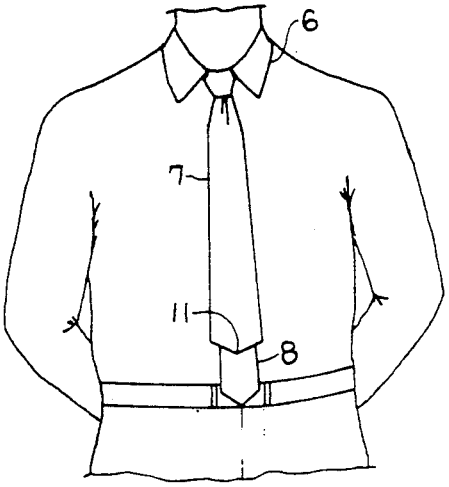
FIG. 6 is a front digrammatic view similar to FIG. 4, illustrating the positions of the ends of the tie after tying a knot therein.
Figure 7:
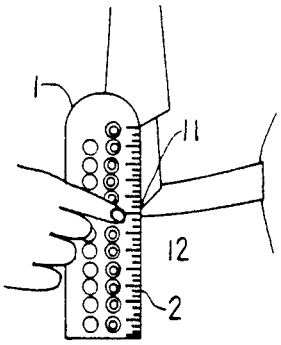
FIG. 7 is an enlarged diagrammatic view showing placement of the support member on the tie with the scale measuring the distance between the first narrow end and the second wide end.

However, it is more common that the tie 5 does not drape in the desired position. This condition is illustrated in FIG. 6, where the second, wide tie end 7 is undesirably higher than the first, narrow tie end 8. The the wearer then decides where he would prefer the tip 11 of the wide tie end 7 to fall. As shown in FIG. 7, this would be the lower edges of his belt. The tie user then employs scale 2 of support member 1 to measure the distance from the tip 11 of the wide tie end 7 to the lower edge 12 of the belt, which is the tie resting point, as shown in FIG. 7.

Figure 8:
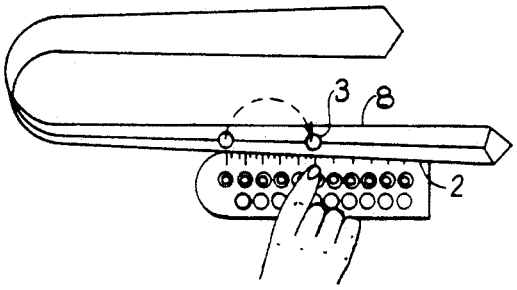
FIG. 8 is an enlarged diagrammatic view showing use of the support member to reposition the temporary marker element farther from the wide tie end by an amount equal to the distance measured in FIG. 7.

The tie 5 may then be removed from the collar 6 to facilitate relocation of the temporary marker element 3. As shown in FIG. 8, the wearer uses scale 2 to relocated temporary marker element 3 closer to the tip of the narrow tie end 8 by the amount which was measured in FIG. 7. As illustrated in FIG. 8, the temporary marker element 3 is repositioned a distance measured in FIG. 7.

Figure 9:
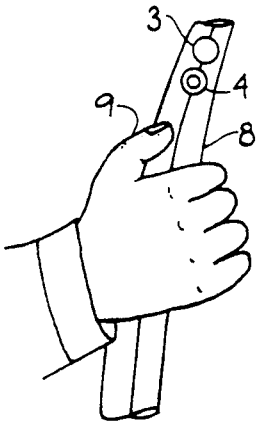
FIG. 9 is an enlarged fragmentary diagrammatic view showing placement of a permanent marker element adjacent the temporary marker element on the tie.
Figure 12:
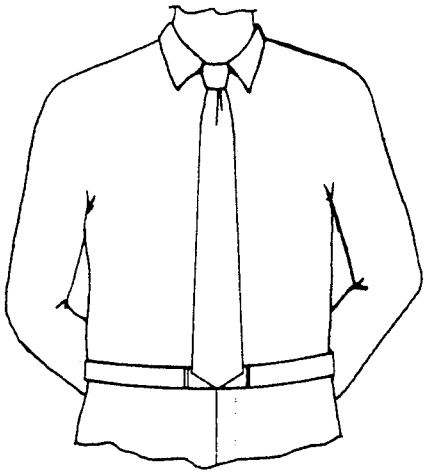
FIG. 12 is a front diagrammatic view similar to FIG. 10, showing the tie with the knot tied therein after the tie has been positioned as shown in FIG. 11, with the wide, second end of the tie falling in the desired position.

The wearer may then verify the accuracy of the temporary marker element 3 position by grasping the tie 5 as shown in FIG. 4 with the end of the wearer's thumb 9 adjacent the temporary marker element 3, as ilustrated in FIG. 5. The wearer then slides the tie 5 along the collar 6 whereby the temporary marker element 3 is adjacent the collar button 10, which consitutes the chosen location point. The wearer then reties the tie 5 using the same style knot employed initially, which should result in the wide end 7 being located in the desired position as shown in FIG. 12. Having thus verified the correctness of the temporary marker element 3, the wearer then removes a permanent marker element 4 from the support member 1, and places it adjacent to and downside of temporary marker element 3 as shown in FIG. 9. Temporary marker element 3 is then removed leaving the permanent marker element 4 correctly positioned for all future knot tying.

Figure 13:
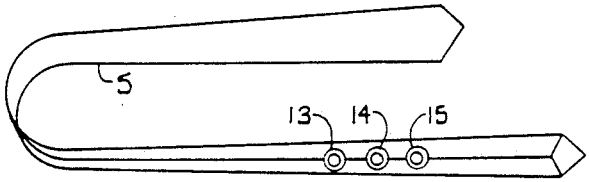
FIG. 13 is an elevational view of a tie as used in the present invention provided with three permanent marker elements corresponding to different style knots.

As shown in FIG. 13, a plurality of marker elements may be employed on the same tie 5 to permit proper positioning of the tie 5 for several different knots. For example, a permanent marker element 13 is shown which was affixed when a four-in-hand knot was tied during the marker element locating process. A second marker element 14 was positioned and affixed employing a half-Windsor knot, while a third marker element 15 was positione and affixed after tying a Windsor knot. By employing the marker elements as set forth hereinabove, the tie wearer may now use the marker element 13, 14 or 15 corresponding to the style of knot he wishes to tie.

Figure 10:
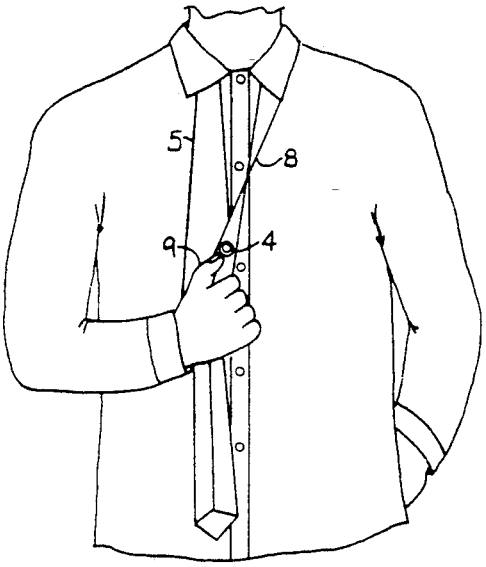
FIG. 10 is a front diagrammatic view similar to FIG. 6, illustrating positioning of the permanent marker element on the tie with the tie in the fold of the wearer's collar.
Figure 11:
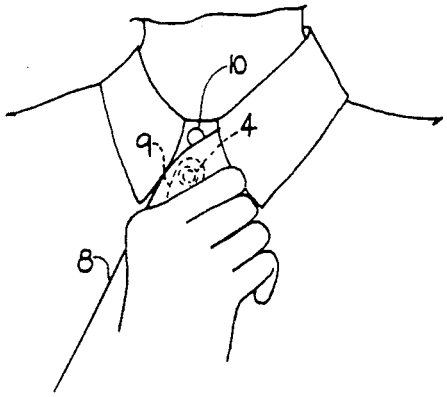
FIG. 11 is an enlarged fragmentary diagrammtic view showing the permanent marker element in phantom adjacent a collar button constituting the chosen location point.

For subsequent knot-tying evolutions, the wearer initially positions the tie 5 in a customary manner as illustrated in FIG. 2, wherein the tie is held between the folded elements of the shirt collar 6. In this manner, wide tide end 7 and narrow tie end 8 may drape loosely in a generally downwardly direction. The wearer then grasps the narrow tie end 8 having a permanent marker element 4 positioned thereon as shown in FIG. 10, wherein the end of the wearer's thumb 9 rests on the marker element 4. The wearer then slides the tie 5 around the collar 6 so that the narrow end 8 moves upwardly until the end of the wearer's thumb 9 touches the collar button 10 or other chosen location point. So positioned, the tie is ready for tying by the wearer in his usual manner using the same style knot as used in establishing the location of the permanent marker element 4. After tying, the tie 5 will drape precisely as desired.

I claim:

1. A method of tying a necktie presenting a first end and a second end for wear about the collar of a human wearer comprising the steps of:

affixing a small marker element which is visually and tactily distinguishable from the material of the necktie to the necktie;

positioning said affixed marker element proximate a chosen location point on one of the wearer's apparel and anatomy; and draping said tie around the collar of the wearer with said first and second ends draping from opposing sides of the wearer's collar whereby, upon tying of the tie by the user in the user's habitual manner, the first and second ends of the tie will be located in a desired position.

2. A method of tying a necktie presenting a first end and a second end for wear about the collar of a human wearer comprising the steps of:

positioning the tie about the collar of the wearer with the first end and the second end dangling downwardly from opposing sides of the collar;

selecting a fixed reference point on one of the anatomy and apparel of the wearer that will always be in the same relative location to the wearer's body;

affixing a small marker element that is visually and tactily distinguishable from the material of the tie to the tie adjacent said reference point;

tying the tie in a desired knot;

locating a measuring element on the tie for measuring the distance of a selected one of the first or second tie ends from the desired location of the selected tie end;

moving the marker element along said measured distance;

reaffixing the marker element to the tie;

repositioning the tie whereby the marker element is located adjacent the fixed reference point; and retying the tie using said knot.

3. A method as set forth in claim 2 including the step of verifying the location of the first end and second end after retying said knot to determine if said first end and said second end are in the desired location.

4. A method as set forth in claim 2 wherein said knot is a Windsor knot.

5. A method as set forth in claim 2 wherein said knot is a half-Windsor knot.

6. A method as set forth in claim 2 wherein said knot is a four-in-hand knot.

7. A method as set forth in claim 2 wherein said fixed reference point is a button on a shirt worn by the wearer.

8. A method as set forth in claim 2 including affixing a second marker element on said tie corresponding to a second, different knot tied by said wearer.

9. A method of tying a tie presenting a first end and a second end for wear about the collar of a human wearer comprising the steps of:

positioning the tie about the collar of the wearer with the first end and the second end dangling downwardly from opposing sides of the collar;

selecting a fixed reference point on one of the anatomy and apparel of the wearer that will always be in the same relative location to the wearer's body;

positioning a temporary marker element adjacent the fixed reference point;

tying the tie in a desired knot;

establishing the combined lengths of the first end and second end extending beyond the knot;

positioning a measuring substrate presenting a scale thereon adjacent a selected one of said first end and said second end with a scale adjacent said selected one end;

measuring a distance between said one selected end and a tie resting point defined on one of the anatomy and apparel of the wearer;

moving the temporary marker element along the tie said measured distance;

repositioning the tie about the collar of the wearer with the temporary marker adjacent the reference point;

retying the tie in the desired knot; and replacing the temporary marker element with a permanent marker element.

10. A method as set forth in claim 9 including the step of positioning an additional marker element on said the corresponding to a different style knot.

11. A support member for use in connection with tying a necktie, said support member comprising:

a thin elongated substrate presenting at least one edge;

indicia defining a scale imprinted along said edge; and a plurality of marker elements removably attached to said substrate, each of said marker elements being visually and tactily distinguishable from the necktie.

12. A support member as set forth in claim 11 wherein said marker elements include at least one temporary marker and at least one permanent marker.

13. A support member as set forth in claim 11 wherein said temporary marker elements present at least one side and include means on said one side for removably affixing said temporary marker elements to the necktie.

14. A support member as set forth in claim 12 wherein said means for removably affixing said temporary marker includes a pressure-sensitive adhesive coating.

15. A support member as set forth in claim 11 wherein said permanent marker elements present at least one side and include means on said one side for affixing said permanent marker to the necktie.

16. A support member as set forth in claim 14 wherein said means for affixing said permanent marker includes a pressure sensitive adhesive coating.

17. A support member as set forth in claim 11 including a row of temporary markers and a row of permanent markers.

* * * * *